United States Patent [19]

Weber

[11] Patent Number: 4,742,862

[45] Date of Patent: May 10, 1988

[54] FOUNDRY CORE SHOOTER

[75] Inventor: Andre Weber, Saverne, France

[73] Assignee: Kuhn S.A., Saverne, France

[21] Appl. No.: 16,359

[22] Filed: Feb. 19, 1987

[30] Foreign Application Priority Data

Feb. 19, 1986 [FR] France ..... 86 02363

[51] Int. Cl.[4] ..... B22C 19/04

[52] U.S. Cl. ..... 164/154; 164/200; 164/201

[58] Field of Search ..... 164/200, 201, 202, 12, 164/16, 19–21, 154, 456

[56] References Cited

U.S. PATENT DOCUMENTS 3,059,294 10/1962 Dunn et al. .
4,190,097 2/1980 Allread et al. .

FOREIGN PATENT DOCUMENTS 0123756 4/1983 European Pat. Off. .
1920920 4/1969 Fed. Rep. of Germany .
1112402 9/1954 France .
1383990 11/1963 France .

*Primary Examiner*—Kuang Y. Lin
*Attorney, Agent, or Firm*—Oblon, Fisher, Spivak, McClelland & Maier

[57] ABSTRACT

A support comprising table receives core boxes of variable size. A shooting head adapts automatically to the size of the core boxes. A gassing head adapts automatically to the size of the core boxes.

52 Claims, 7 Drawing Sheets

FOUNDRY CORE SHOOTER

BACKGROUND OF THE INVENTION

1. Field of the Invention

This invention relates to a foundry core shooter comprising a support device of core boxes, a shooting head and a gassing head.

2. Background of the Related Art

The known foundry machines have numerous drawbacks.

Actually, on some machines, it is possible to mount only a single size of core box for a given setting of the machine. This means that if a piece to be cast requires several different cores, the casting of the piece can begin only when all the cores are produced, or by working on a number of machines corresponding to the number of cores that the piece comprises. In the first case, it will be necessary to provide a storage area for the various cores made until the casting of the pieces can actually begin. This storage obviously poses great problems. In the second case, it will be necessary to have a set of several core shooters and to tie up this set of shooters for the production of cores of a single given piece.

Further, some machines accept only core boxes of a well-defined size so that, during modernization of the set of machine, it can happen that existing core boxes could no longer be used on the new machines.

Moreover, if a set of machines comprises different machines each accepting core boxes of a well-defined size, there will be obvious problems in the case of peak production periods, since a machine generally cannot accept a box provided for another machine.

This then obviously causes a great rigidity in the production of cores, and high production costs, which are hardly acceptable.

Moreover, on many types of existing machines, dismounting of the core box to recover the produced core, remounting of said core box and gassing generally are not done in off time which also considerably increases production times and consequently production costs.

Finally, the machines of the prior art are built for a well-determined use. Thus, there are machines more specifically suited to large-scale production, while others are more specially suited to small-scale production.

SUMMARY OF THE INVENTION

The object of this invention is to create a foundry core shooter which does not have the drawbacks of the machines of the prior art, i.e., which can accept core boxes of very different sizes, so that this machine is very versatile and enables production of cores to be extremely flexible.

For this purpose, the foundry core shooter according to the invention comprises in combination a support device of core boxes comprising support means which can receive core boxes of variable size, a shooting head comprising adaptation means which allow the shooting head to adapt automatically to the size of said core boxes, and a gassing head comprising adaptation means which allow the gassing head to adapt automatically to the size of said core boxes.

Thanks to this combination of elements, the core shooter according to the invention totally meets the established objective.

Actually, it should first be noted that the invention makes it possible to produce different cores simultaneously, so that if a piece to be cast comprises several cores, casting of the pieces can begin approximately at the same time as production of the cores, while using only a single machine. The problems of storage of cores or of tying up of the entire set of machines are thus completely solved.

Moreover, the machine according to the invention can serve to produce cores either on a large scale or small scale. The machine can thus be adapted exactly to the series of cores to be produced, which makes it possible, in each case, to obtain the lowest possible production costs and times. Actually, in the case of large-scale production, it is possible to equip all the work stations of the machine with identical core boxes. Thus the machine will always produce the same core. In the case of small scale production, it is possible to equip each work station of the machine with a different box. The machine will thus simultaneously produce several different cores but in small amounts. Any intermediate case, located between these two extreme cases, can of course be envisaged. Thus, in the case of medium scale production, only some stations of the machine will be equipped with identical boxes. The machine according to the invention therefore, as just shown, has a very great flexibility in use.

Moreover, since the machine according to the invention accepts core boxes of variable size, the purchaser of a machine according to the invention can use most of the existing boxes. In this way, the machine is very quickly made operational. This characteristic also makes it possible to solve most of the problems described above which appear during peak periods.

According to an additional characteristic of the invention, the adaptation means of the shooting head making it possible automatically to adapt the shooting head to the various core boxes, comprise means for moving the shooting head, means for detection of the size of the core boxes and means to stop the movement of the shooting head toward the core box.

The sequence of adaptation of the shooting head to the size of the core box is achieved in the following way. The means for moving the shooting head which comprise means for guiding the shooting head and driving means moving the shooting head along the guide means, cause the movement of the shooting head in the direction of the core box. The detection means detect the size of said core box and control the stop means which themselves act on the driving means to stop the movement of the shooting head, when the latter occupies the desired shooting position.

According to the invention, the detection means and/or means for stopping the movement of the shooting head toward the core box can advantageously consist of the upper face of the core box which thus serves as a stop for the shooting head during its movement toward the core box. It should be noted that the detection means and stop means can act simultaneously.

According to an additional characteristic, the adaptation means of the shooting head also comprise means for locking the shooting head in shooting position. This allows a good absorption of shocks during shooting of the core.

Advantageously, these means of locking the shooting head are operated by the means for stopping the shooting head.

According to another characteristic, the machine according to the invention can also comprise unlocking means which automatically unlock the locking means of the shooting head after shooting of the core.

The adaptation means of the gassing head making it possible to adapt the gassing head automatically to the different core boxes also comprise means for movement of the gassing head, means for detecting the size of the core box and means for stopping the movement of the gassing head.

The sequence of adaptation of the gassing head is achieved in a way similar to that of the shooting head. Actually, the means for movement of the gassing head which comprise means for guiding the gassing head and driving means moving the gassing head along the guide means, cause the movement of the gassing head in the direction of the core box. Detection means detect the size of the core box and control the stop means which themselves act on driving means to stop the movement of the gassing head, when the latter occupies the desired gassing position.

According to the invention, the means for detection and/or the means for stopping the movement of the gassing head toward the core box can advantageously consist of the upper face of the core box which thus serves as the stop for the gassing head during its movement toward the core box. It should be noted that the detection means and the stop means can act simultaneously.

According to another characteristic, the support means of the core boxes comprise means for holding the core boxes, suited for holding core boxes of variable size.

Advantageously, these holding means can comprise means for automatic locking and unlocking of the core boxes that are to be held.

According to an additional characteristic, the machine comprises a computer which makes it possible to program the number of shoots, as also the period of gassing which each core box requires. This computer is connected to identification means, able to identify each core box.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
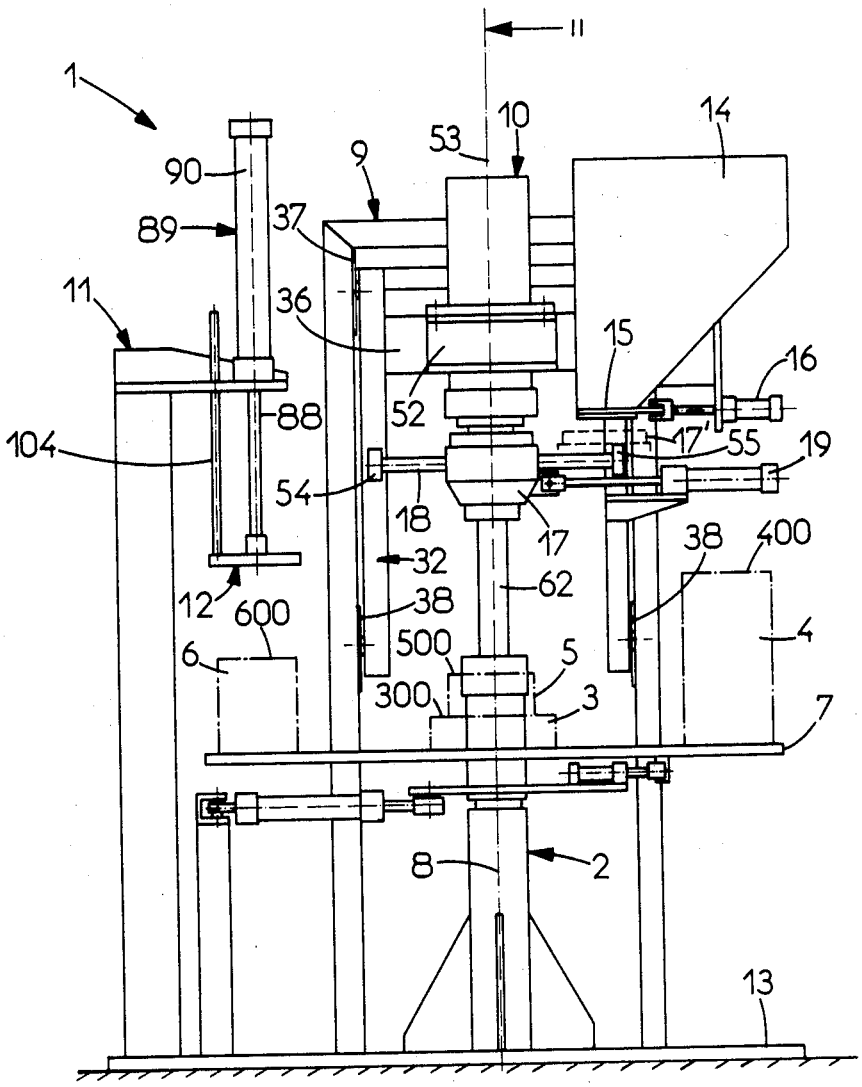
FIG. 1 is a diagrammatic front view of the core shooter according to the invention.

Core shooter (1) of the invention comprises a support device (2) of core boxes (3, 4, 5, 6). This support device (2) comprises support means which, in the example described, are formed by a table (7) on the upper face (700) of which are placed the core boxes (3, 4, 5, 6). This table (7) is approximately horizontal and can revolve around an axis of rotation (8) which extends approximately vertically.

Machine (1) further comprises a gantry (9) which supports a shooting head (10). This shooting head (10) can be moved approximately vertically to be brought closer to or farther away from table (7).

Machine (1) further also comprises a bracket (11) which supports a gassing head (12). This gassing head (12) can also be moved approximately vertically to be brought closer to or farther away from table (7).

Support device (2), gantry (9), as well as bracket (11), are connected to a base (13) which makes it possible to fasten machine (1) on the floor of a core shop.

In FIG. 1 it is also seen that gantry (9) also supports a hopper (14) in which is maintained a reserve of core sand, which can be fed by the central reserve of the core shop. The base of this hopper (14) is provided with a trap (15) whose opening and closing are controlled by a jack (16).

Shooting head (10) includes a metering device (17) which can be brought under trap (15) of hopper (14) to be filled with core sand. For this purpose, metering device (17) which is made in the form of a small container, is mounted on horizontally extending slides (18). The movement of metering device (17) along slides (18) is achieved by a jack (19). (FIG. 1 partially shows in broken lines (17') the metering device (17) when it is under hopper (14) waiting to be filled with core sand.)

Shooting head (10) with its metering device (17) is conventional (for example, the shooting head known by the trademark FOMES) and consequently will not be described in detail.

Figure 3:
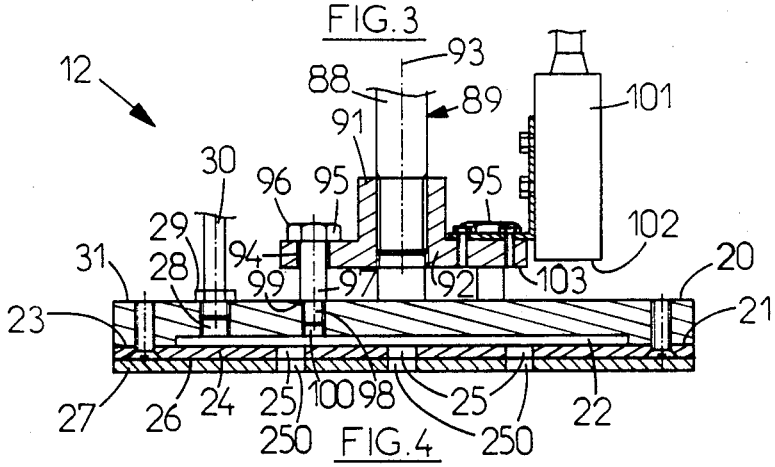
FIG. 3 is a front view in section along line III of the gassing head.
Figure 4:
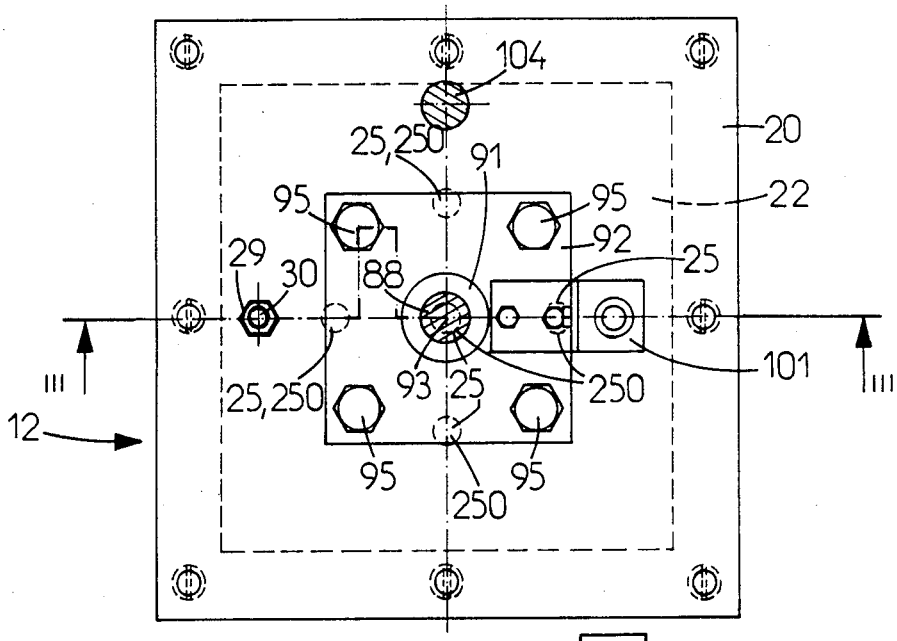
FIG. 4 is a top view of the gassing head of FIG. 3, partially in section.
Figure 5:
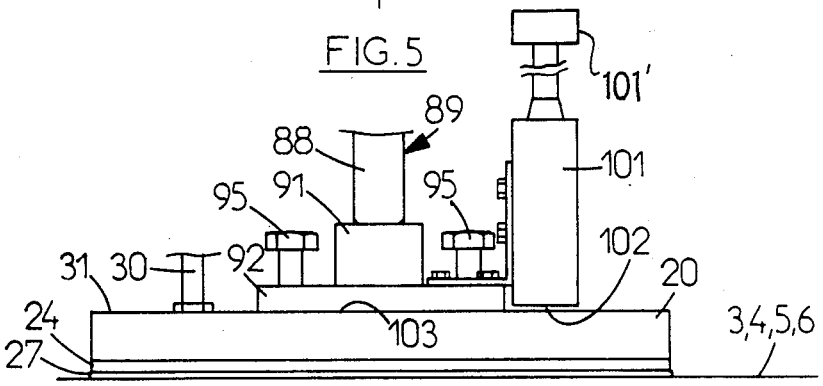
FIG. 5 is a front view of the gassing head of FIGS. 3 and 4, in gassing position.

Gassing head (12) is shown in greater detail in FIGS. 3, 4 and 5. This gassing head (12) is made up of a plate (20) which has a cavity (22) on its lower face (21). On outside edge (23) of lower face (21) of plate (20), which delimits cavity (22), is fastened a counterplate (24). This counterplate (24) is provided with a certain number of holes (25) which go all the way through counterplate (24) and which come out into cavity (22). Counterplate (24) also has on its lower face (26) a seal (27). This seal (27) has holes (250) which correspond in position to holes (25) of counterplate (24) and which go all the way through seal (27). Moreover, in plate (20) is formed a threaded hole (28) which goes all the way through plate (20) and which comes out into cavity (22). In threaded hole (28) is screwed tip (29) of a gas intake pipe (30) which is thus fastened to the upper face (31) of plate (20).

As stated above, shooting head (10) can be brought close to table (7) for automatically adapting to the size of core boxes (3, 4, 5, 6). This is one of the important characteristics of core shooter (1) according to the invention. For this purpose, shooting head (10) and its metering device (17) are mounted on a carriage (32).

Figure 2:
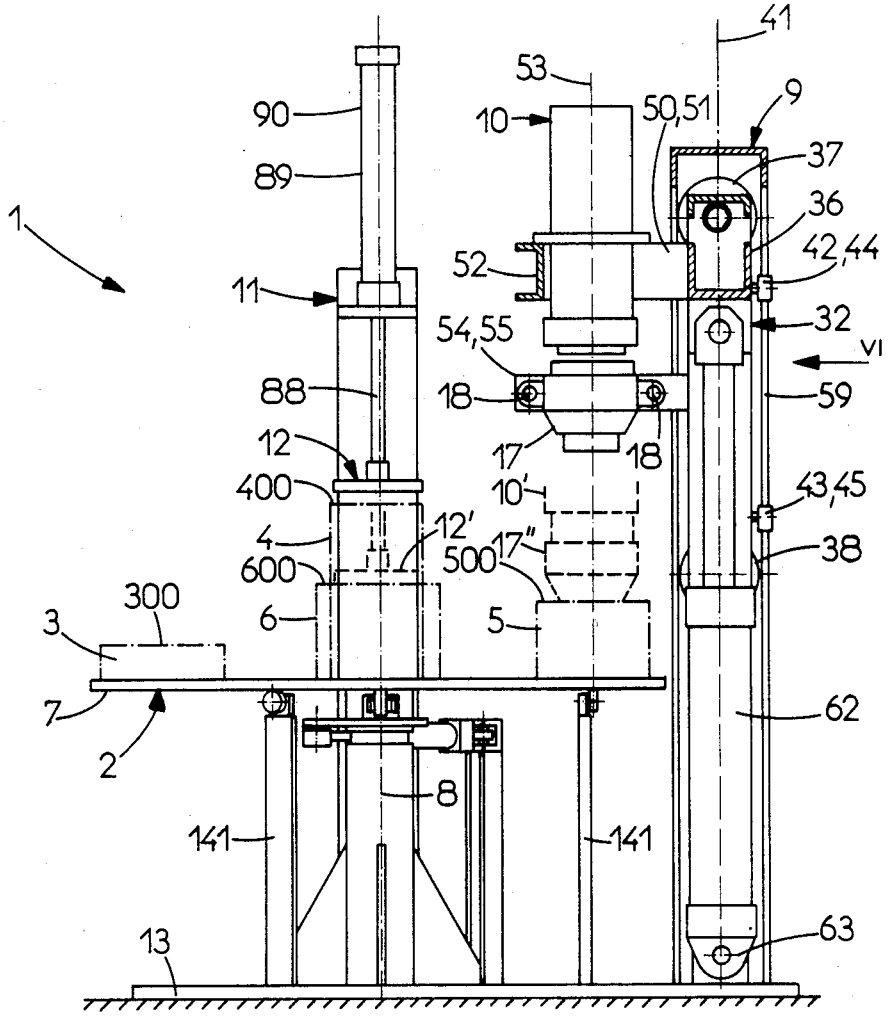
FIG. 2 is a view along line II, partially in section, of the machine of FIG. 1.
Figure 6:
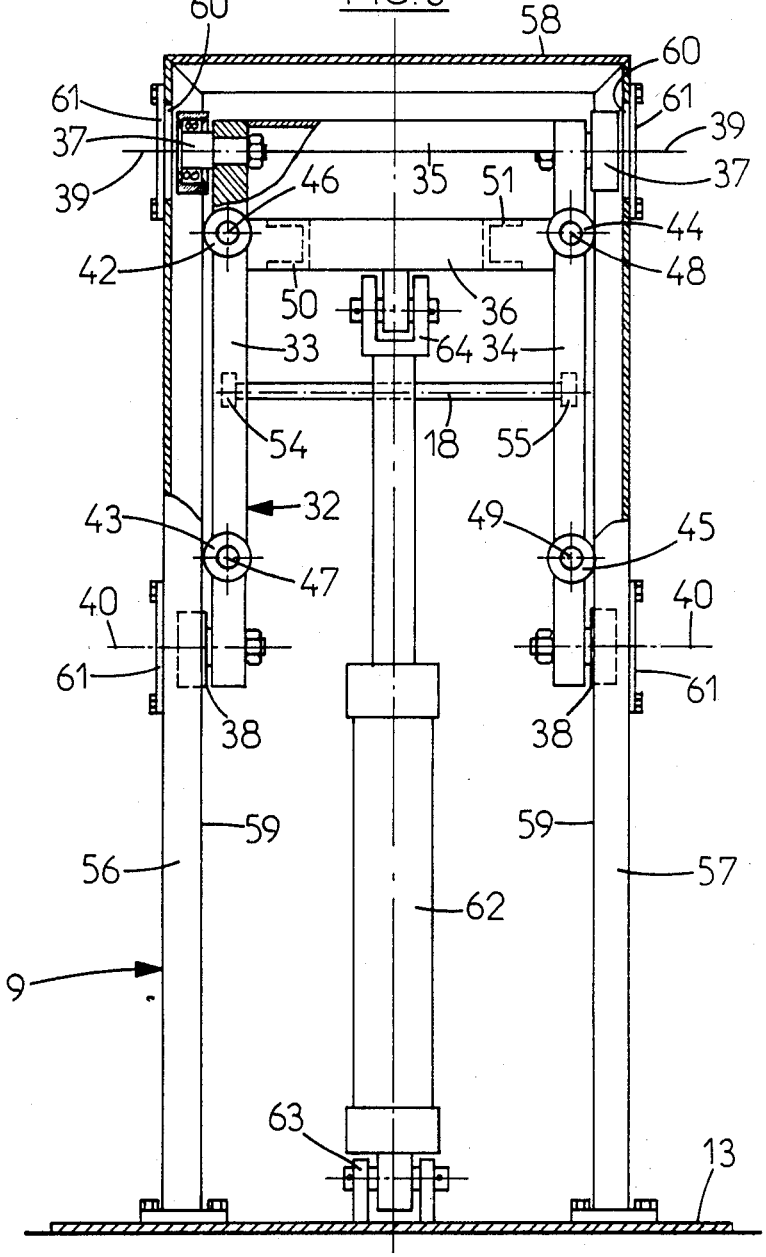
FIG. 6 is a view along direction VI of the gantry and carriage of the shooting head in FIG. 2.
Figure 8:
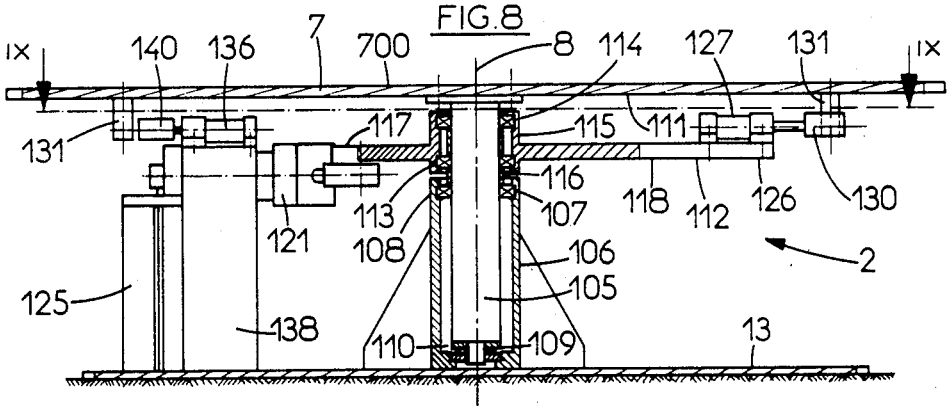
FIG. 8 is a front view in section along line VIII of the table.

Carriage (32) appears in detail in FIGS. 1, 2 and 6. It is made up of two side members (33, 34) which are connected together at their upper part by two crossbeams (35, 36). Each side member (33, 34) is provided at each of its ends with a roller (37, 38). The axes of rotation (39, 40) of these rollers (37, 38) extend approximately horizontally and are contained in a plane approximately parallel to plane (41) of carriage (32).

Each side member (33, 34) is provided with two other rollers (42, 43, 44, 45) which extend, as can be seen in FIG. 6, between rollers (37, 38). The axes of rotation (46, 47, 48, 49) of rollers (42, 43, 44, 45) also extend approximately horizontally, but are approximately perpendicular to plane (41) of carriage (32).

On lower crossbeam (36) of carriage (32) are fastened two beams (50, 51) which extend approximately horizontally and whose longitudinal axes extends approximately perpendicular to plane (41) of carriage (32). At their end away from crossbeam (36), the two beams (50, 51) are connected together by a crossbeam (52). The two beams (50, 51) and crossbeam (52) serve to fasten shooting head (10) to carriage (32), so that axis (53) of shooting head (10) extends approximately vertically.

The two side members (33, 34) of carriage (32) are also provided with two beams (54, 55) which extend approximately parallel to beams (50, 51). These two beams (54, 55) support the two slides (18) of metering device (17) of shooting head (10), which extend approximately parallel to plane (41) of carriage (32).

Carriage (32) which has just been described is guided in translation in gantry (9) by rollers (37, 38) and rollers (42, 43, 44, 45). For this purpose, gantry (9) includes two approximately vertical standards (56, 57) which are connected together at their upper end by a crossbeam (58). Gantry (9) thus formed is fastened to base (13).

The two standards (56, 57) of gantry (9) consist of U-shaped sections whose open part is directed toward the inside of gantry (9). These two U-shaped standards (56, 57) serve as a guide track for rollers (37, 38) when carriage (32) is moved in gantry (9). Rollers (42, 43, 44, 45) travel on back wing (59) of U-shaped standards (56, 57) and serve to guide carriage (32) laterally. The guide paths of rollers (37, 38) and (42, 43, 44, 45) can advantageously be equipped with a tempered steel part to avoid wear.

Standards (56, 57) of gantry (9) also have holes (60) plugged with removable covers (61). These holes (60) allow mounting said dismounting of rollers (37, 38) and thereby mounting and dismounting of carriage (32) of gantry (9).

Movement of carriage (32) and shooting head (10) in gantry (9) is performed by a jack (62) which is advantageously a hydraulic jack. This jack (62) extends approximately in plane (41) of carriage (32) and is fastened, on the one hand, to base (13) by means of a clevis (63) and, on the other hand, to lower crossbeam (36) of carriage (32) by means of another clevis (64).

Figure 7:
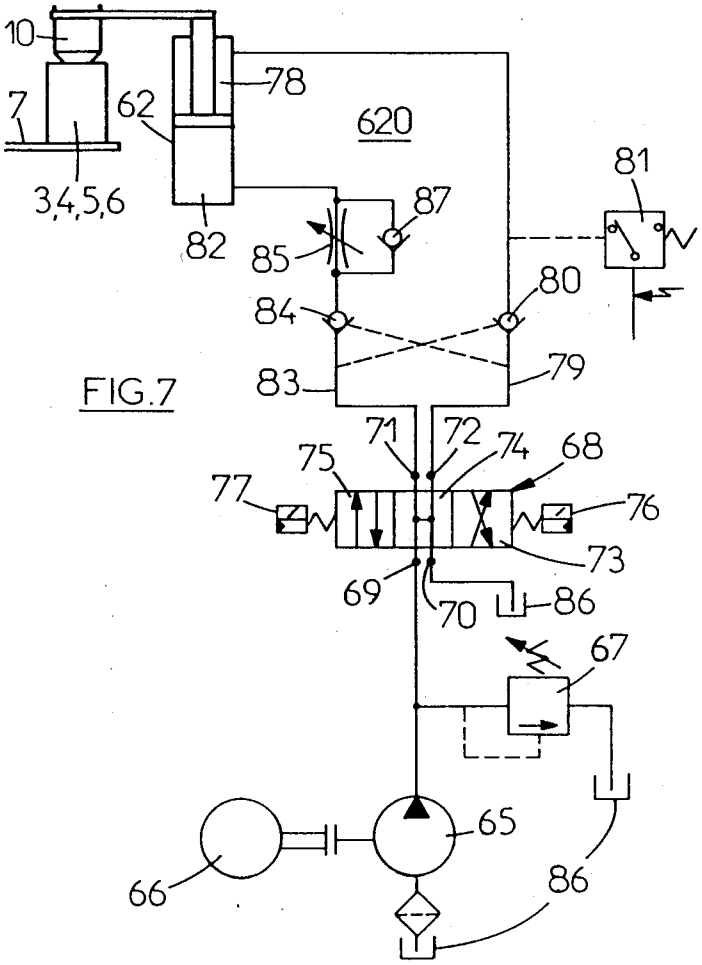
FIG. 7 is a diagram of the hydraulic circuit of the jack for lowering and raising of the shooting head.

Feeding of this jack (62) is performed by a hydraulic circuit (620) which is shown in FIG. 7.

This circuit is fed by a pump (65) driven by a motor (66). The pressure of the oil delivered by pump (65) is limited by a pressure limiter (67). The circuit extends to a distributor (68) with four terminals (69, 70, 71, 72), a slide valve with three compartments (73, 74, 75) and its two push rods (76, 77). Terminal (72) of distributor (68) is connected to chamber (78) of jack (62) on the rod side of the jack by a pipe (79) having a controlled check valve (80) and a pressostat (81). Terminal (71) of distributor (68) is connected to the other chamber (82) of jack (62) by a pipe (83) having a controlled check valve (84) and a flow regulator (85). The dashed lines in FIG. 7 indicate that the controlled check valves (80) and (84) are of the type which open in response to a sufficient pressure in the pipe of the other valve.

The circuit that has just been described works as follows. To bring shooting head (10) to the core box to be shoot, push rod (76) of distributor (68) is actuated, which brings compartment (73) to the level of terminals (69, 70, 71, 72). The oil delivered by pump (65) then enters by terminal (69), leaves by terminal (72), goes through check valve (80) and enters into chamber (78) on the rod side of jack (62). The oil contained in chamber (82) is expelled when the pressure of pipe (79) has opened controlled check valve (84). This oil expelled from chamber (82) of jack (62) goes through flow regulator (85) which regulates the reentry speed of the rod of jack (62), i.e., the speed of descent of carriage (32) and of shooting head (10).

When shooting head (10) comes in contact with upper face (300, 400, 500, 600) of core box (3, 4, 5, 6), its descent is stopped, as is the reentry of the rod of jack (62) into the cylinder of said jack (62). Since feeding of pipe (79) is continued, the oil pressure in the latter rises until the opening pressure of pressostat (81) is reached. At that moment, pressostat (81) deactivates push rod (76), via control means which are not shown, which has the effect of bringing compartment (74) to the level of terminals (69, 70, 71, 72). Due to this being done, the oil contained in chambers (78, 82) of jack (62) can no longer circulate because it is blocked by check valves (80 and 84), and jack (62) together with carriage (32) and shooting head (10) are locked. The oil that pump (65) continues to deliver returns directly to tank (86).

After shooting of the core, shooting head (10) must be made to go up again, i.e., the rod of jack (62) must go out of the cylinder. To do this, push rod (77) is actuated which has the effect of bringing compartment (75) to the level of terminals (69, 70, 71, 72). The oil delivered by pump (65) goes through terminal (69), comes out through terminal (71), passes through check valve (84) and check valve (87), which short-circuits in this direction flow regulator (85), and enters chamber (82) of jack (62), as soon as the pressure in pipe (83) operates the opening of check valve (80) of pipe (79) so that the oil contained in chamber (78) of jack (62) can return to tank (86).

Thanks to this arrangement, it can be seen that shooting head (10) can automatically adapt to core boxes (3, 4, 5, 6) of very different size, since the core box itself triggers the termination of the descent of shooting head (10). The core box also automatically locks shooting head (10) during shooting of the core. This is very important because it enables the machine to adequately absorb the shock generated by the shooting of the core.

It is further seen that the arrangement of this circuit also allows the automatic unlocking of shooting head (10) before the shooting head (10) goes up again.

Another important characteristic of core shooter (1) according to the invention resides in the fact that gassing head (12) can also be brought close to table (7) by automatically adapting to the size of core boxes (3, 4, 5, 6). For this purpose, gassing head (12) is fastened to the free end of rod (88) of a jack (89) which advantageously is a pneumatic jack. Cylinder (90) of jack (89) is fastened to bracket (11). The connection between the free end of rod (88) of jack (89) and of gassing head (12) appears in greater detail in FIGS. 3, 4 and 5. In these figures, it is seen that the free end of rod (88) of jack (89) is screwed into a flange (91) whose plate (92) extends approximately perpendicular to longitudinal axis (93) of rod (88). This plate (92) is provided with four holes (94) through which bolts (95) pass. These bolts (95) have a special shape. Actually, under their head (96), the shank of the bolts (95) comprises a first part (97) of a certain diameter and of a certain length, to which is then connected a second part (98) of a smaller diameter than the diameter of first part (97), so that between these two parts (97, 98) there is a shoulder (99). Second part (98) of the shank of bolts (95) is threaded so that the bolts (95) can be screwed into threaded holes (100) made in upper face (31) of plate (20), until shoulder (99) comes to strike against upper face (31) of plate (20). After locking of bolts (95), head (96) of bolts (95) is thus a certain distance from upper face (31) of plate (20). In FIG. 3 it is also seen that the diameter of holes (94) of plate (92) of flange (91) is somewhat larger than the diameter of first part (97) of bolts (95) so that the plate (92) can slide on the bolts (95). It is also seen that the thickness of plate (92) is less than the distance that separates the lower face of heads (96) of bolts (95) and upper face (31) of plate (20).

Moreover, on plate (92) of flange (91) is fastened a known end-of-travel detector (101) so that lower face (102) of the end-of-travel detector (101) is slightly raised in relation to lower face (103) of plate (92) located opposite upper face (31) of plate (20).

To keep gassing head (12) from being able to turn in relation to rod (88) of jack (89), plate (20) is provided with a guide (104) fastened to plate (20) and which goes through a guide hole made in bracket (11). The longitudinal axis of guide (104) is approximately parallel to the longitudinal axis of rod (88) of jack (89), i.e., approximately vertical.

Gassing head (12) and the adaptation means which enable gassing head (12) to adapt automatically to the size of core boxes (3, 4, 5, 6) function as follows. When a core box (3, 4, 5, 6) is in gassing position (core box (6), for example, in FIGS. 1 and 2), jack (89) is fed, which causes the descent of gassing head (12) toward the core box. When seal (27) comes in contact with upper face (300, 400, 500, 600) of the core box, the descent of plate (20) stops. Jack (89), on the other hand, continues to push on flange (91) until lower face (103) of plate (92) of flange (91) comes in contact with upper face (31) of plate (20). The thrust of jack (89) on upper face (31) of plate (20) then compresses seal (27) between lower face (26) of counterplate (24) and upper face (300, 400, 500, 600) of the core box to prevent gas leaks. When seal (27) is correctly compressed, the descent of rod (88) of jack (89) is stopped and the pressure is maintained in jack (89) so that seal (27) remains correctly compressed during the entire gassing operation. This gassing operation begins only when gassing head (12) is in place.

The initiating of the gassing operation is performed by initiating means (101') in response to end-of-travel detector (101). Actually this detector (101) detects upper face (31) of plate (20) when lower face (103) of plate (92) of flange (91) comes approximately in the vicinity of upper face (31) of plate (20) (position shown in FIG. 5 which represents the gassing position). Given the possible relative movement between plate (92) of flange (91) and plate (20), this latter is actually achieved only when gassing head (12) is in contact with upper face (300, 400, 500, 600) of the core box. On the other hand, during the approach phase, detection of upper face (31) of plate (20) cannot occur since upper face (31) of plate (20) is too far away from lower face (102) of detector (101) (position shown in FIG. 3).

During gassing, the gas is introduced by intake pipe (30) into cavity (22) from which it is then distributed by holes (25) of counterplate (24) and holes (250) of seal (27) into the core box to be gassed.

The rise of gassing head (12) will occur after the gassing operation, whose period is programmed as a function of the size of the core. This programming is done by a computer which will be discussed below.

Thanks to this arrangement, it is seen that gassing head (12), like shooting head (10), can automatically adapt to core boxes (3, 4, 5, 6) of very different sizes since the core box itself triggers stopping of the descent of gassing head (12) and triggering of the gassing operation.

Another important characteristic of core shooter (1) according to the invention relates to support device (2) of core boxes (3, 4, 5, 6). This support device (2) is shown in FIGS. 1, 2, 8, 9, 10 and 11, and includes table (7). This table (7) is preferably circular, extends approximately in a horizontal plane and can rotate around an approximately vertical axis (8). For this purpose table (7) has approximately at its center a pivot shaft (105) which extends downward and whose longitudinal axis is colinear with axis of rotation (8). Pivot shaft (105) engages in a bearing (106) which is fastened to base (13). Guiding of pivot shaft (105) during rotation in bearng (106) is performed by a bearing (107) which is positioned in the upper part (108) of bearing (106), and by a thrust bearing (109) positioned in lower part (110) of the bearing (106). Thrust bearing (109) also keeps pivot shaft (105) from moving axially downward. Bearing (106) does not extend to lower face (111) of table (7) so that between upper part (108) of bearing (106) and lower face (111) of table (7) pivot shaft (105) can rotatably support a lever (112). Guiding of lever (112) on pivot shaft (105) is performed by two bearings (113, 114) housed in a hub (115) of lever (112). A certain spacing is maintained between lever (112) and bearing (106) by a brace (116). Lever (112) comprises two arms (117, 118) of which one (117) extends on one side of hub (115) and the other (118) extends on the other side of hub (115).

At its free end, arm (117) of lever (112) is connected to rod (120) of a jack (121) by means of a pin (122). Cylinder (123) of jack (121) is connected in an articulated manner by a pin (124) to a standard (125) fixed to base (13).

Figure 9:
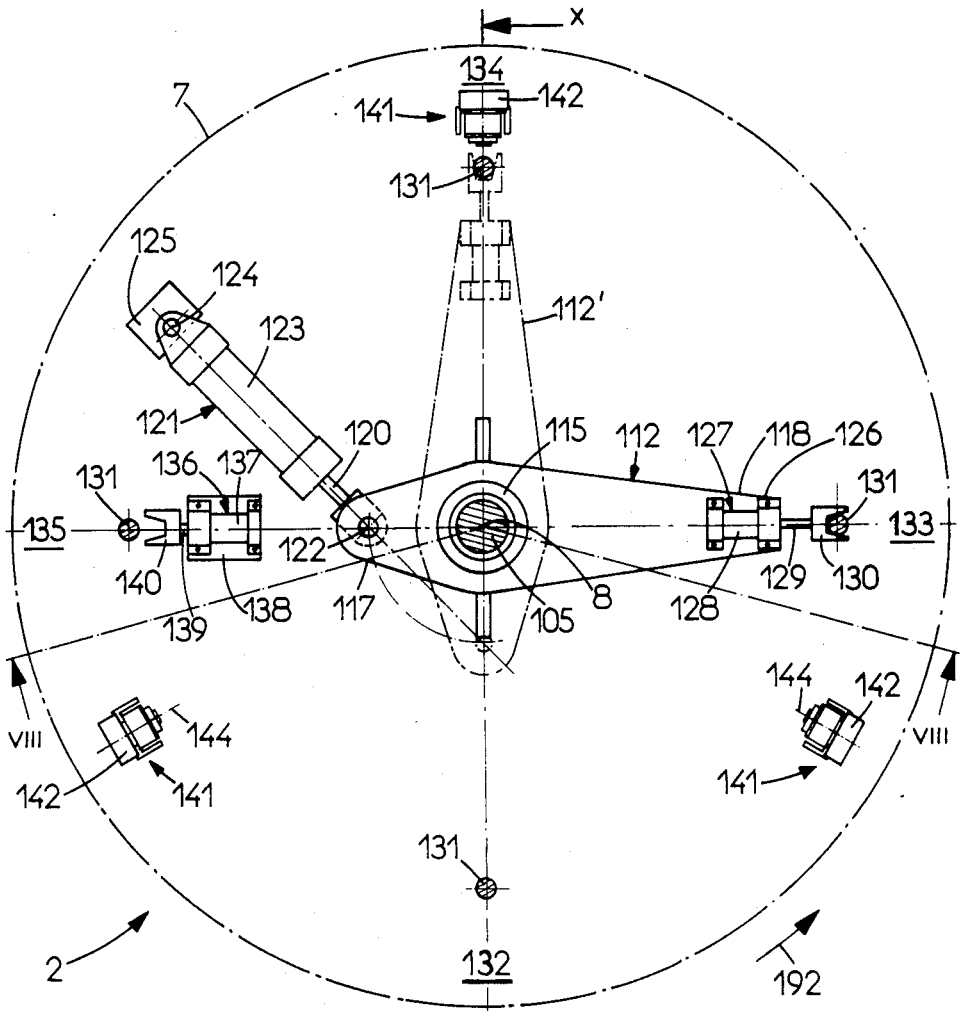
FIG. 9 is a top view, partially in section, along line IX of the table of FIG. 8.
Figure 11:
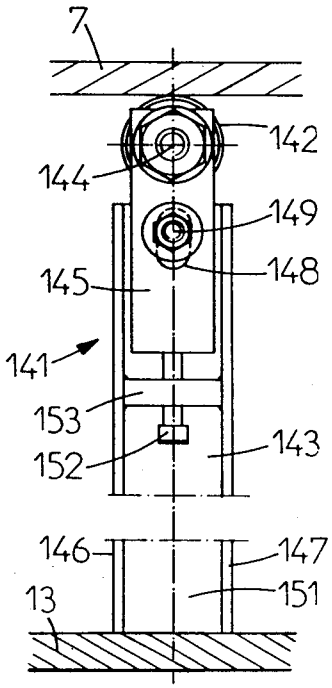
FIG. 11 is a view along direction XI of the support shown in FIG. 10.
Figure 10:
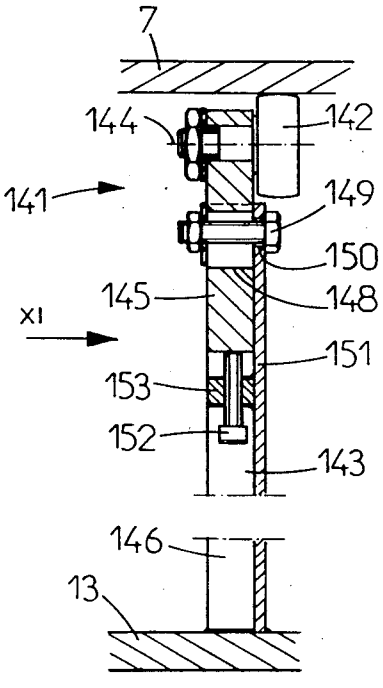
FIG. 10 is a view in section along line X of a support of the table.

Arm (118) supports at its free end (126) a jack (127) whose cylinder (128) is fixed to arm (118). The free end of rod (129) of jack (127) comprises a V-shaped piece (130) whose V is open toward the outside. When rod (129) of jack (127) is extended, the V-shaped piece (130) engages an indicator (131) fixed to table (7). This indicator (131) consists of a cylindrical stud which, when it is engaged with V-shaped piece (130), extends between the wings of said V. In FIG. 9 it is seen that table (7) has four such indicators (131). It will be noted that the number of indicators (131) that table (7) has corresponds to the number of core boxes (3, 4, 5, 6) provided to be supported simultaneously by table (7). In the example shown, table (7) can simultaneously support four core boxes. Dismounting and remounting of the core boxes occurs at (132). (133) corresponds to an intermediate position. Shooting of the core occurs at (134) and gassing of the core at (135).

Another jack (136) is also provided to engage an indicator (131) of table (7). Cylinder (137) of this jack (136) is fastened to a standard (138) fixed to base (13). The free end of rod (139) of said jack (136) comprises also a V-shaped piece (140) similar to V-shaped piece (130) of jack (127).

Jack (127) engages an indicator (131) to make table (7) turn around axis of rotation (8) while jack (136) engages an indicator (131) during operation to block the rotation of table (7).

The mechanism that has just been described and serving to make table (7) rotate (by quarter turn in the embodiment) and to lock table (7) during work, functions as follows. Driving jack (127) is operated so that V-shaped driving piece (130) is brought into engagement with an indicator (131) of table (7). Then locking jack (136) is actuated to separate V-shaped locking piece (140) from indicator (131) with which it was engaged. Then driving jack (121) is actuated to extend rod (120). By operating this way, rod (120) pushes on arm (117) of lever (112), causing the rotation of the latter around axis (8). Since V-shaped driving piece (130) of driving jack (127) engages an indicator (131) of table (7), the rotation of lever (112) will also cause the rotation of table (7) around axis (8). The travel of driving jack (121) is such that table (7) makes a quarter turn in the example described. When driving jack (121) is at the end of its elongation travel, lever (112) is in position (112') represented in dot-and-dash lines in FIG. 9. At this moment, locking jack (136) is actuated again to extend its rod (139) so that V-shaped locking piece (140) of said jack (136) can engage indicator (131) which has been brought opposite it during the rotation of table (7). The driving jack (127) is then actuated to separate it from indicator (131) with which it engaged during rotation of table (7). Finally, driving jack (121) is actuated so that its rod (120) again retracts into cylinder (123). By doing this, rod (120) pulls on lever (112). When driving jack (121) is at the end of its retraction travel (position in solid lines in FIG. 9), the mechanism is again ready for the next rotation of table (7).

In FIGS. 2, 9, 10 and 11 it is seen that table (7) rests on supports (141), at least one of which extends to beneath zone (134) of shooting head (10) substantially at the level of axis (53) of shooting head (10). This support (141) located under shooting head (10) enables table (7) to well absorb the shock generated during shooting of the core. (In FIG. 1, supports (141) have not been shown so as not to clutter the Figure.)

In the embodiment shown, supports (141) are three in number and are located equidistant from one another. They consist of rollers (142) which are fastened to the upper part of standards (143) fixed to base (13), such as appears in FIGS. 10 and 11. Rollers (142) revolve around approximately horizontal axes (144) which approximately intersect axis of rotation (8) of table (7). In the example, standards (143) consist of U-shaped sections. Each standard (143) is provided at its upper part with a roller-carrying arm (145) which extends between two wings (146, 147) of the U-shaped section. At its upper end, roller-carrying arm (145) supports roller (142) for rotation. Between its two ends, roller-carrying arm (145) is provided with an oblong hole (148) through which a bolt (149) passes. This bolt (149) further also goes through a hole (150) made in the core (151) of standard (143). At its lower end, roller-carrying arm (145) is in contact with a adjusting screw (152) which is screwed into a nut (153) fixed to standard (143).

Thanks to this arrangement, the position of each roller (142) can be adjusted in relation to table (7). To bring roller (142) in contact with table (7), bolt (149) is loosened, then thrust is exerted on the lower end of roller-carrying arm (145) by means of adjusting screw (152), which will cause sliding of roller-carrying arm (145) in standard (143). This sliding is possible, since hole (148) made in roller-carrying arm (145) and through which bolt (149) passes, is an oblong hole. When roller (142) is in contact with table (7), it then suffices to tighten bolt (149) to connect roller-carrying arm (145) rigidly to its standard (143).

Figure 12:
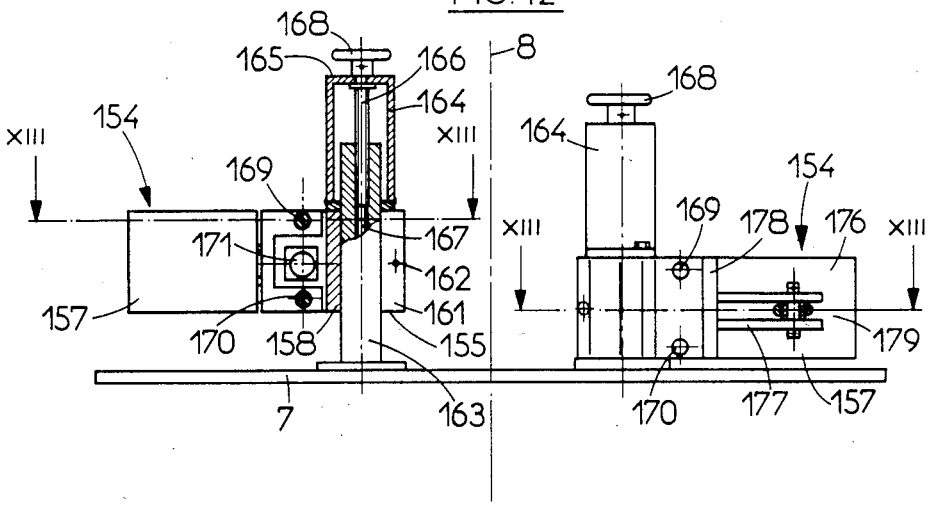
FIG. 12 is a partial view along line XII, partially in section, of the means for holding the core boxes.
Figure 13:
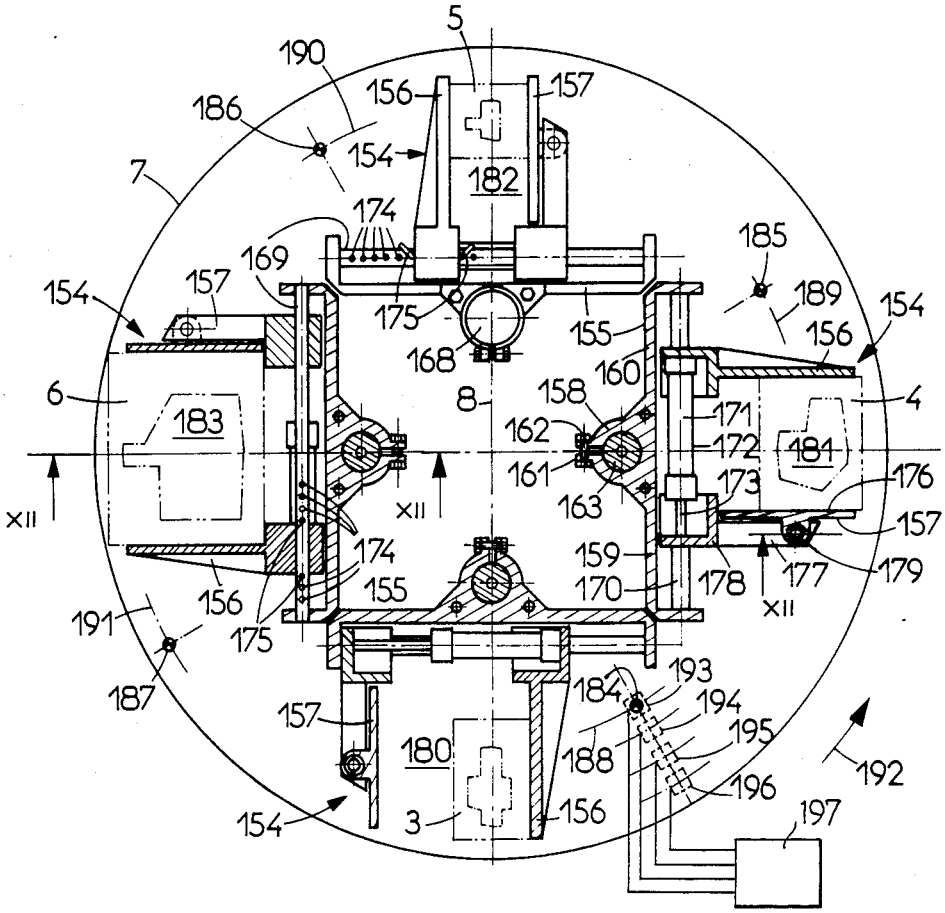
FIG. 13 is a top view, partially in section, long line XIII of the holding means and table of FIG. 12.

FIGS. 12 and 13 show an embodiment of means (154) for holding of core boxes (3, 4, 5, 6). These holding means (154) hold the core boxes during work. Since they are identical, only one of them will be described. (In FIG. 12, for clarity only holding devices (154) of posts (181 and 183) have been shown.)

Holding means (154) comprises a jaw holder (155) which is provided with two jaws (156, 157). Each jaw holder (155) includes a bearing (158) having two wings (159, 160) so that, seen from the top, the two wings, (159, 160) form a U opened outward. At the back, bearing (158) is open to form a clamp (161) which can be locked by a bolt (162). Bearing (158) of jaw holder (155) is slipped onto a stud (163) fastened to the upper face of table (7). Jaw holder (155) further comprises above bearing (158) an actuation cylinder (164) which is fastened to the top of bearing (158) of jaw holder (155). Actuation cylinder (164) is closed at its upper part (165). This closed upper part (165) is passed through by an actuation screw (166) which is screwed into a threaded hole (167) made in the longitudinal axis of stud (163). Actuation screw (166) is connected to move in translation with actuation cylinder (164), and to its part that extends beyond actuation cylinder (164) is fastened an actuation wheel (168).

The device that has just been described makes it possible to adjust the position of the jaw holder (155) and consequently of jaws (156, 157) in relation to the size of the core box they are to hold. To do this, it suffices to loosen bolt (162) to open clamp (161), then to turn actuation screw (166) with the aid of wheel (168) to make actuation screw (166) go in or out of stud (163). When jaws (156, 157) have reached a proper position in relation to the core box, it will then suffice to tighten clamp (161) by locking bolt (162).

Between two U-shaped wings (159, 160) extend two slides (169, 170) on which jaws (156, 157) can slide. Between the two slides (169, 170) extends a hydraulic jack (171) whose cylinder (172) is fastened to one (156) of the jaws and whose rod (173) is fastened to the other jaw (157).

One (169) of the slides has a certain number of holes (174), in which can be slipped two pins (175) on both sides of one (156) of the jaws and which will serve to connect in translation one (156) of the jaws to one (169) of the slides. In this way, the core box intended for this holding means (154) will always be in approximately the same place on table (7), i.e., advantageously centered in relation to shooting head (10) and gassing head (12).

Closing of jaws (156, 157) is performed by actuating jack (171) so as to cause its rod (173) to retract into its cylinder (172). This will move jaw (157) which can slide freely on slides (169, 170) until it comes into contact with the core box to be held. Holding of the core box is maintained, for example, by keeping jack (171) under pressure.

In FIG. 13 it can also be seen that the two jaws (156, 157) are different from one another. Actually, jaw (157) comprises a swiveling locking plate (176). For this purpose, jaw (157) includes a clevis (177) fastened to its part (178) for connecting to slides (169, 170). To the end of this clevis (177) is connected locking plate (176) by means of a ball-and-socket joint (179). In this way, swiveling locking plate (176) can be positioned well in relation to the core box if this latter does not have parallel faces. This guarantees an optimal holding of the core box.

In FIG. 13, it can also be seen that each post (180, 181, 182, 183) is provided with an indicator (184, 185, 186, 187) which is fastened to table (7). These indicators (184, 185, 186, 187) are arranged on circles (188, 189, 190, 191) of different radius and centered on axis of rotation (8) of table (7). These indicators (184, 185, 186, 187) pass, during the course of rotation of table (7) which is always made in the same direction (192), over sensors (193, 194, 195, 196) which are fastened to base (13) and which consequently do not rotate with table (7). Each sensor (193, 194, 195, 196) is located at a distance from axis of rotation (8) of table (7) which is equal to the radius of circle (188, 189, 190, 191) over which its corresponding indicator (184, 185, 186, 187) rotates.

The passage of an indicator (184, 185, 186, 187) over its sensor (193, 194, 195, 196) is transmitted to a programmable computer (197) known to those in the art such as, for example, the TELEMECANIQUE TSX 7, and will indicate, for example, to said computer (197) the start of the cycle made by each core box (3, 4, 5, 6) for which there will be programmed, in the computer (197), the number of shootings and the necessary gassing periods.

Various modifications can be made in the example of embodiment that has just been described, without thereby going outside the scope of the present invention.

What is claimed as new and desired to be secured by Letters Patent of the United States is:

1. An apparatus comprising:
- means for supporting a plurality of core boxes of same or variable sizes;
- a shooting head positioned above said means for supporting;
- first means for downwardly and upwardly moving said shooting head;
- first means for terminating downward movement of said shooting head in response to engagement with a top of a core box supported on said means for supporting;
- a gassing head positioned above said means for supporting;
- second means for downwardly and upwardly moving said gassing head; and
- second means for terminating downward movement of said gassing head in response to engagement with a top of a core box supported on said means for supporting.

2. The apparatus according to claim 1 wherein said first means for downwardly and upwardly moving include guide means for guiding said shooting head and driving means for displacing said shooting head along said guide means.

3. The apparatus according to claim 2 wherein said guide means comprise:
- a fixed gantry;
- guide tracks mounted on said gantry;
- a carriage to which said shooting head is fixed; and
- a plurality of rollers rotatably mounted on said carriage and guided or said guide tracks.

4. The apparatus according to claim 3, wherein said guide tracks comprise U-shaped sections in which said rollers travel.

5. The apparatus according to claim 4, wherein said guide tracks are constituted by standards of said gantry.

6. The apparatus according to claim 4, wherein said carriage defines a plane within which the axes of said rollers extend.

7. The apparatus according to claim 6 including a plurality of additional rollers rotatably mounted on said carriage, the axes of rotation of said additional rollers extending perpendicular to said plane.

8. The apparatus according to claim 7, wherein said additional rollers are guided on one of the wings of said U-shape sections.

9. The apparatus according to claim 2, wherein said driving means comprise a double acting hydraulic jack connected between said carriage and a stationary portion of said apparatus, and means for actuating said hydraulic jack.

10. The apparatus according to claim 1, wherein said first means for terminating comprise stop means stopping the movement of said shooting head in the direction of said core box.

11. The apparatus according to claim 10, wherein said first means for terminating further comprise means for locking a position of said shooting head in response to engagement of said shooting head with the top of the core box.

12. The apparatus according to claim 10, wherein said stop means are constituted by said top of said core box which serves as a stop for the shooting head during movement toward the core box.

13. The apparatus according to claim 11, wherein said locking means are actuated by said stop means.

14. The apparatus according to claim 1, wherein said second means for terminating include stop means stopping the movement of said gassing head in the direction of said core box.

15. The apparatus according to claim 13, wherein said first means for moving comprise a double hydraulic jack, and wherein said first means for terminating comprise a hydraulic circuit for said hydraulic jack, said hydraulic circuit comprising:
- a hydraulic fluid pump;
- a fluid reservoir
- a first fluid line connecting said pump or said fluid reservoir with one chamber of said jack;
- a second fluid line connecting another chamber of said jack with said pump or said fluid reservoir;
- distributor valve means in said first and second fluid lines movable into a locking position for selectively simultaneously mutually connecting said first and second fluid lines and isolating said first and second chambers of said jack from said pump and said reservoir;
- pressostat means in said first fluid line for moving said distributor valve means into said locking position in response to a pressure in said first line exceeding a predetermined value; and means in said first and second lines for preventing circulation of fluid in said first and second lines when said distributor valve means is in said locking position, whereby engagement of said shooting head with the top of the core box prevents further downward movement of said shooting head and causes a fluid pressure in said first line to exceed said predetermined value, to thereby cause said pressostat to move said distributor valve means to said locking position, and to thereby locking the position of said shooting head in respect to said core box.

16. The apparatus according to claim 15, wherein said distributor valve means further comprises an unlocking position for connecting said pump to said second line and said fluid reservoir to said first line, whereby the elevation of pressure in said second line causes to open said means for preventing circulation of fluid in said first and said second lines, to thereby cause the hydraulic jack to move the shooting head away from the core box.

17. The apparatus according to claim 15, wherein said distributor valve means comprise a three way sliding valve.

18. The apparatus according to claim 15, wherein said means for preventing circulation comprise at least one controlled check valve in each of said first and second fluid lines.

19. The apparatus according to claim 1 wherein said second means for downwardly and upwardly moving include guide means for guiding said gassing head and driving means for displacing said gassing head along said guide means.

20. The apparatus according to claim 19, wherein said guide means and said driving means comprise:

a fixed bracket;

a jack having a rod, said gassing head being fixed to said rod; and means for preventing rotation of said gassing head around the axes of said rod.

21. The apparatus according to claim 20, wherein said jack comprises a pneumatic jack.

22. The apparatus according to claim 14, wherein said stop means are constituted by said top of said core box which serves as a stop for the gassing head during movement toward the core box.

23. The apparatus according to claim 20, wherein said gassing head comprises:

a plate having a cavity in a lower side thereof;

a counterplate having a plurality of holes and covering said cavity; and means for delivering a gas to said cavity.

24. The apparatus according to claim 23, including a seal covering said counterplate and having holes at positions corresponding to said holes of said counterplate.

25. The apparatus according to claim 20, including means for permitting a limited relative movement substantially in the direction of the length of said rod between said rod and said gassing head.

26. The apparatus according to claim 25, wherein said means for permitting limited relative movement comprise a plurality of headed bolts extending from an upper surface of said plate and a flange fixed to said rod, said bolts being slidable in holes of said flange, said apparatus further comprising:

means for detecting when said flange is in proximity with said upper surface of said plate; and means for initiating a gassing operation in response to said means for detecting.

27. The apparatus according to claim 1, wherein said means for supporting a plurality of core boxes comprise:

a rotary table rotatable about a fixed axis; and a pivot shaft rotatably supporting said rotary table for rotation about said fixed axis.

28. The apparatus according to claim 27 including means for incrementally rotating said table about fractions of a complete revolution.

29. The apparatus according to claim 28, wherein said means for incrementally rotating comprise:

a support lever pivotable on said pivot shaft;

a plurality of indicator elements fixed to an underside of said support table, said indicator elements being circumferentially spaced by said fractions of a complete revolution;

means for pivoting said support lever to an angular position corresponding to that angular position between two of said indicator elements; and means on an end of said support lever for selectively engaging said support lever with one of said indicator elements.

30. The apparatus according to claim 29, wherein said indicator elements each comprise a cylinder, wherein said means for engaging comprise a V-shaped piece movably mounted on said support lever so that said cylinder can fit into said V-shape.

31. The apparatus according to claim 30, wherein said means for engaging further comprise a jack whose cylinder is fixed on said support lever and whose rod carries the v-shaped piece.

32. The apparatus according to claim 28, including a fixed locking device having means for selectively engaging one of a plurality of indicator elements circumferentially spaced by said fractions of a complete revolution.

33. The apparatus according to claim 32, wherein said means for selectively engaging one of said indicator elements comprise a V-shaped piece movably mounted on said locking device so that said cylinder can fit into said V-shape.

34. The apparatus according to claim 33, wherein said means for selectively engaging further comprise a jack whose cylinder is fixed to a fixed point of the apparatus and whose rod carries the v-shaped piece.

35. The apparatus according to claim 27, wherein said pivot shaft extends vertically and a top surface of said rotary table on which the core boxes are supported extends horizontally.

36. The apparatus according to claim 27, including additional table support means at least one of which extends to beneath a shooting zone of said shooting head.

37. The apparatus according to claim 36, wherein said additional table support means are adjustable, whereby the position of said additional table support means can be adjusted in respect of said table.

38. The apparatus according to claim 36, wherein said additional support means include rollers engageable with said rotary table.

39. The apparatus according to claim 35, including means mounted on said top surface of said rotary table for holding core boxes of different sizes.

40. The apparatus according to claim 39, wherein each of said means for holding core boxes of different sizes comprise:

a jaw holder fixed to said top surface of said rotary table;

slide means fixed to said jaw holder; and jaws slidably mounted on said slide means, whereby a spacing between said jaws can be adjusted to hold core boxes of different sizes.

41. The apparatus according to claim 40, including adjustable means for locking one of said jaws in a position on said slide means.

42. The apparatus according to claim 41, wherein said adjustable means for locking said one of said jaws comprise:

a plurality of holes in said slide means; and pin means fittable in at least one of said holes, whereby said pin means prevent movement of said one of said jaws.

43. The apparatus according to claim 39, including means for adjusting a height of said means for holding above said rotary table to thereby adapt the height of said means to the size of the core box.

44. The apparatus according to claim 40, including means for adjusting a height of said jaws above said table.

45. The apparatus according to claim 44, wherein said means for adjusting the height of said jaws of each jaw-holder comprise a stud fixed on said table and comprising a longitudinally extending threaded hole;

a bearing arranged on said jaw-holder and slipped on said stud;

a clamp on said bearing for clamping said jaw-holder on said stud;

an actuation cylinder on said bearing; and an actuation screw connected to move in translation with said actuation cylinder, and screwed in said threaded hole of said stud.

46. The apparatus according to claim 40, including a hydraulic jack for actuating the one of said jaws slidable on said slide means.

47. The apparatus according to claim 46, wherein said hydraulic jack is connected between said jaws.

48. The apparatus according to claim 40, including a locking plate pivotally mounted by means of a ball-and-socket joint on at least one of said jaws.

49. The apparatus according to claim 28, including means for detecting the incremental rotation of said rotary table.

50. The apparatus according to claim 49, wherein said means for detecting comprise:

a plurality of recognition indicators mounted on said rotary table at different angular and radial positions, and corresponding each to a core box; and a plurality of stationary sensors located at different radial positions, whereby each of said sensors can sense a different one of said recognition indicators.

51. The apparatus according to claim 50, wherein said sensors transmit the passage of a recognition indicator to a programmable computer on which is programmed the number of shooting and the necessary gassing period of the respective core box.

52. The apparatus according to claim 51, wherein the passage of one of said sensors over the respective recognition indicator indicates the start of the cycle made by the corresponding core box.

* * * * *